United States Patent [19]

Hori

[11] 4,239,222

[45] Dec. 16, 1980

[54] PINBALL GAME FLIPPER MECHANISM

[75] Inventor: Noritoshi Hori, Tokyo, Japan

[73] Assignee: Tomy Kogyo Co., Inc., Tokyo, Japan

[21] Appl. No.: 65,214

[22] Filed: Aug. 9, 1979

[30] Foreign Application Priority Data

Aug. 11, 1978 [JP] Japan ..... 53-110674[U]

[51] Int. Cl.[3] ..... A63B 71/00

[52] U.S. Cl. ..... 273/129 W; 273/121 R; 273/127 C; 273/DIG. 26

[58] Field of Search ..... 124/79, 1, 16; 273/85 R, 85 A, 121 R, 121 A, 121 D, 121 E, 129 W, 129 R, 119 R, 119 A, 89, 87.2, 87.4; 46/128

[56] References Cited

U.S. PATENT DOCUMENTS

| | | | |
|---|---|---|---|
| 975,316 | 11/1910 | Barrett | 273/119 R |
| 3,975,019 | 8/1976 | Barlow | 273/121 A |
| 4,078,800 | 3/1978 | Goldfarb | 273/89 |

*Primary Examiner*—Richard C. Pinkham
*Assistant Examiner*—T. Brown
*Attorney, Agent, or Firm*—Edward D. O'Brian

[57] ABSTRACT

A flipper mechanism for use in a pinball game in conjunction with a playing surface to propel an object across that playing surface comprises a flipper member shaped to have a hub section and a finger section. The finger section includes a striking surface for making contact with and accelerating the object across the playing surface. The playing surface includes at least one upstanding boss projecting from the surface. The interior of the boss is hollow. The hub portion of the flipper member has a generally cylindrical-like surface which includes a spirally inclined cam integrally formed on the cylindrical-like surface. The hub portion of the flipper member fits over the upstanding boss projecting from the playing surface. A button member having a top surface, a cylindrical skirt extending from the top surface and a peg extending from the underside of the top surface downward from the top surface is located over the flipper member and the upstanding boss such that the peg from the button member fits within the hollow interior of the boss. A cam follower is located on the interior of the skirt and when the button member is appropriately located over the flipper member the cam follower mates with and causes the flipper member to rotate as the button member is depressed toward the playing surface.

4 Claims, 8 Drawing Figures

10
12
14
16
18
20
22
24
26
28
32
34
36
38
40
42
44
46
48
50
52
78
96
218
220

40
42
78-a
78-b
78-c
78-d
80
82
84
86
90
92

10
12
22
30
38
40
44
46
54
56
58
59
60
62
64
66
68
70
72
74
76
86
88
90
94
98
100
102
104
106
108
110
112
114
116
118
120
122
124
126
128
130
134
136
142
156
158
194
196
198
200
202
204
206
208
210
212
214
216
4
4

PINBALL GAME FLIPPER MECHANISM

CROSS-REFERENCE TO RELATED APPLICATIONS

This application is related to my application entitled "PINBALL GAME HAVING ACTIVE TARGETS" concurrently filed this day with this application. The contents of that application are herein incorporated by reference.

BACKGROUND OF THE INVENTION

This application describes a target launching mechanism for use in a toy pinball game.

Pinball games have been and still currently are very fascinating to a certain segment of the population. Penny arcade or bar-room type pinball games are quite sophisticated in employing both mechanical and electrical components to dazzle and stimulate their operators. Generally, these games are too sophisticated and/or they are located out of the environment of the younger child. The younger child, however, still finds enjoyment in playing these games. To this end, small scale or child-oriented pinball games have been developed.

Normally the child-type pinball game utilizes a plurality of depressions, holes or the like located in a playing surface which the child uses as a target for a plurality of objects, it being the express purpose of the game to locate one object in each hole of the depression. This does not offer the stimulation and/or fascination of the adult-type pinball games which have moving objects, blinking lights, etc.

Attempts have been made to simulate adult-type pinball games on a small scale. Unfortunately all too often this results in a game, which although it is unsophisticated in operation from the user's point of view, is complex enough to require sophisticated manufacturing procedures which ultimately result in a game being priced out of the range of a large segment of its potential users.

Most adult pinball games incorporate flipper mechanisms therein. The majority of these flipper mechanisms are activated by buttons located on the sides of the game. Once the adult has placed his fingers on these buttons he no longer concentrates on them, but instead concentrates on movement of the object across the playing surface. A child, however, does not have the eye-hand coordination necessary to activate these flipper mechanisms at the proper time to successfully have the flipper mechanism engage with an object such as a ball. Because the activation button for the flipper mechanism is disassociated from the flipper, the lack of the proper eye-hand coordination frustrates the child in his inability to successfully time the flipper to engage with the ball.

BRIEF SUMMARY OF THE INVENTION

In view of the above it is an object of this invention to provide a target launching mechanism for a child's pinball game which locates the flipper activation button in direct association with the flipper arm so that the child may have within his direct view the object on the surface of the pinball game, the flipper arm, and the activating button. It is a further object to construct this mechanism in an expedient and simple manner such that its continued successful operation throughout the life of the pinball game will be insured, and its simplicity will render manufacturing of the mechanism very economical.

These and other objects as will be evident from the remainder of this specification are achieved by providing a flipper mechanism for use with a pinball game having a playing surface and at least one object which can be propelled by the flipper mechanism across the playing surface which comprises: a flipper member having a hub section and a finger section integrally formed together. The finger section includes a striking surface for contacting and accelerating the object across the playing surface. Formed on the playing surface is an upstanding boss which projects upwardly and has a hollow interior. The hub portion of the flipper member includes a bearing means fitting over and rotating about the upstanding boss. At least a portion of the hub section has a generally cylindrical-like surface having a spirally inclined cam integrally formed on the surface. A button member has a top surface with a cylindrical skirt extending downward from the top surface. Extending downward from the inside of the top surface, within the skirt, is a peg. Located on the interior of the skirt is a cam follower which projects from the skirt toward the peg. The button member fits over the flipper member by inserting the peg within the hollow interior of the boss. This positions the cam follower on the button member in operative association with the spirally inclined cam on the flipper member. Depression of the button member causes the cam follower to move against the cam rotating the cam and consequently the flipper member on which it is formed.

BRIEF DESCRIPTION OF THE DRAWINGS

The invention described in this specification and in the appended claims will be better understood when taken in conjunction with the drawings in which:

Figure 1:
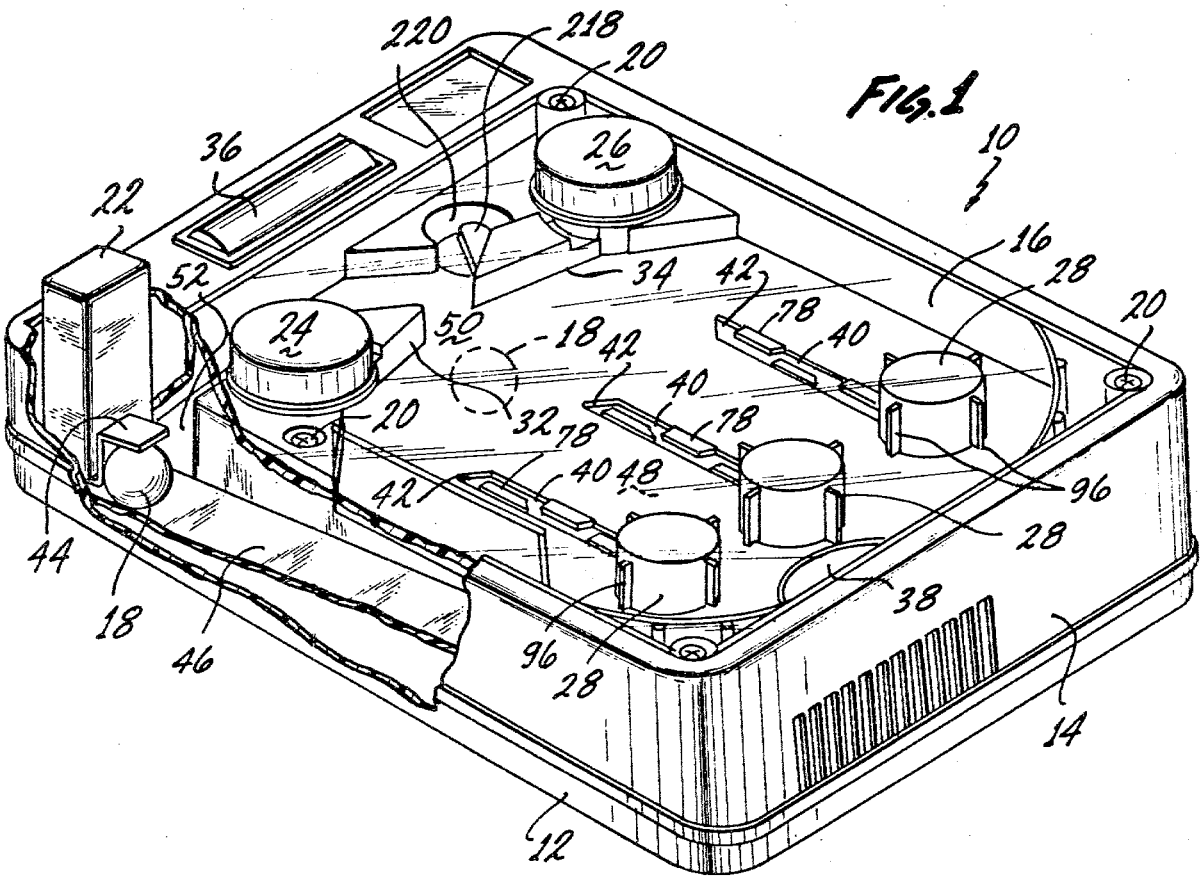
FIG. 1 is an oblique view in partial section of the pinball game which utilizes the invention claimed in the appended claims.

This invention as described in this specification and as illustrated in the drawings utilizes certain operative principles or concepts as are set forth and claimed in the claims appended to this specification. Those skilled in the amusement arts will realize that these concepts and/or principles could be utilized in a number of differently appearing or differently constructed embodiments. For this reason this invention is to be construed in light of the claims and is not to be construed to be limited to the exact embodiment illustrated in the specification and in the drawings.

DETAILED DESCRIPTION

The pinball game 10 includes a lower housing 12 having an upper housing 14 attached thereto by a multiplicity of screws (not identified or numbered) projecting appropriately through the lower housing 12 into the upper housing 14 on the underside of the lower housing 12. Attaching to the upper housing 14 is a clear plastic cover 16 which maintains the object 18, a steel ball, within the confines of the upper housing 14, but allows for appropriate viewing of the game 10. The plastic cover 16 is attached to the upper housing 14 by a multiplicity of screws identified by the numeral 20.

Figure 2:
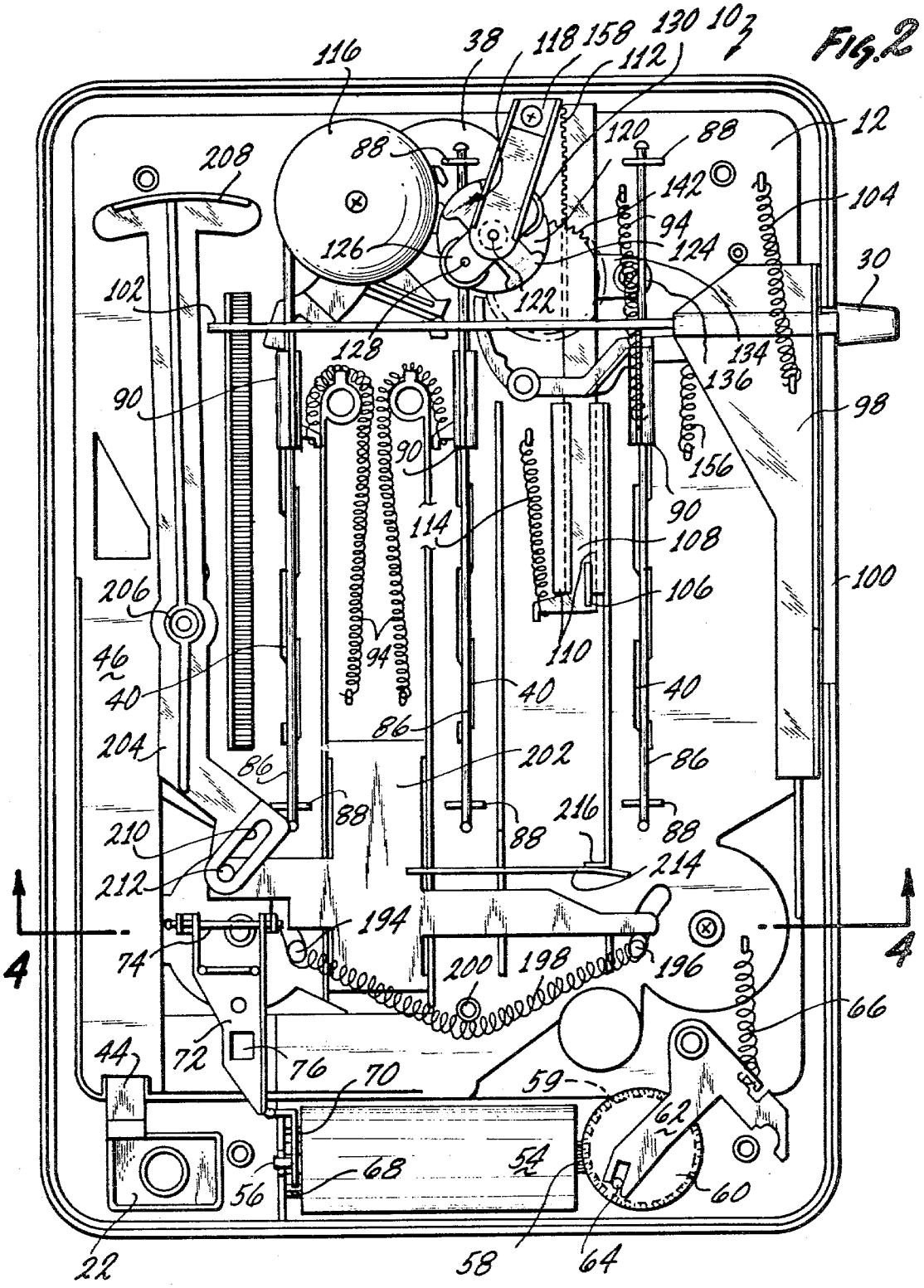
FIG. 2 is a bottom plan view of the game shown in FIG. 1 as viewed with the bottom-most portion of the housing removed showing details of the internal components.
Figure 3:
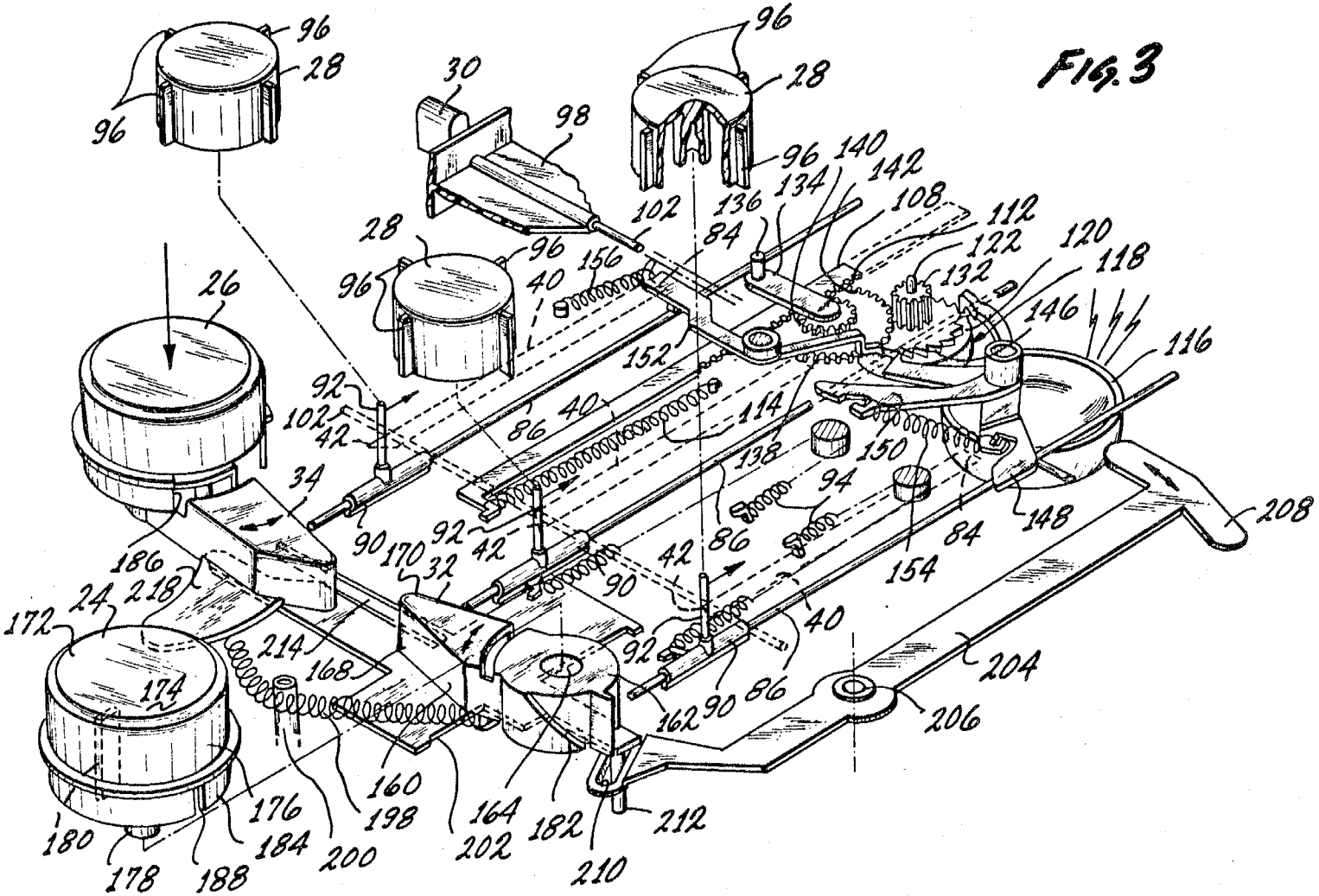
FIG. 3 is an exploded isometric top view of the working components lodged within the housing shown in FIG. 1 with all housing components removed for clarity.
Figure 5:
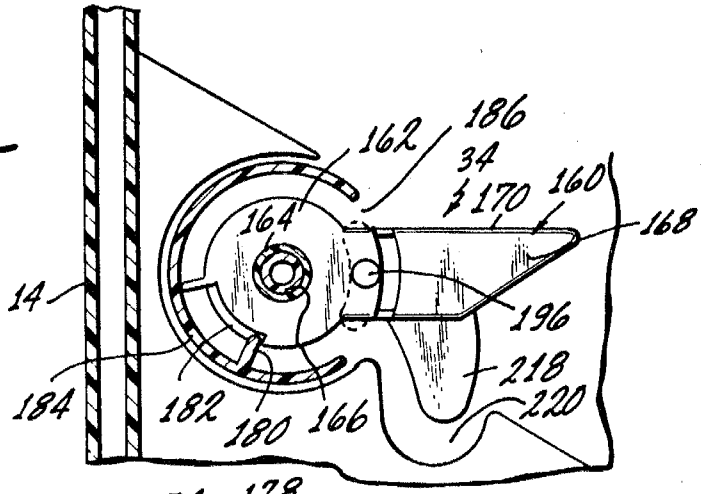
FIG. 5 is a top plan view about the lines 5—5 of FIG. 4 showing a portion of the invention illustrated in FIG. 4.

Projecting through either the upper housing 14 or the plastic cover 16 are three functional push buttons. These, as viewed in FIG. 1, are the object launching button 22, located near the left hand side of FIG. 1; to the right of it is the right side flipper button 24; and to the right and upward is the left side flipper button 26. These buttons 22, 24 and 26 appropriately project through the surface of upper housing 14 or through plastic cover 16 allowing them to be manipulated by the player's fingers. Three object target members, collectively identified by the numeral 28, are seen located underneath the plastic cover 16. Not seen in FIG. 1 but viewable in FIGS. 2 and 3 is the reset button 30 located on the left hand side of upper housing 14.

Also viewable through the plastic cover 16 is a right flipper 32, left flipper 34 and counter 36. Located proximal to object target members 28 is a spinning disk 38, the function of which will be hereinafter described. Traversing down the longitudinal axis of the game 10 within the plastic cover 16 are three passageways collectively identified by the numeral 40, which will be described in greater detail subsequently. Within the upper housing 14 underneath plastic cover 16 are several curved surfaces, baffles, etc. standard to pinball games, the details of which need not be expounded on for the purpose of understanding this specification.

To play the game, the player slides the reset button 30 toward the end of the game 10 wherein the counter mechanism 36 is located which, as will hereinafter be described, causes the object target members 28 to be slid down the passageways 40 also toward the counter 36. The object target members are retained as hereinafter described in an initial position at end 42 of passageway 40. The object 18 is launched by depressing the object button 22. Located on the end of object button 22 which is hidden within the housing members 12 and 14 is an L-shaped member 44. An inclined ramp 46 forming a portion of the upper housing 14 directs the object 18 to roll downwardly toward the object button 22 such that the object 18 fits underneath the L-shaped member 44. When the object button 22 is depressed the force of the depression is transferred to the L-shaped member 44 which squeezes against the object 18 while concurrently being distorted backward toward the object button 22. When the pressure between the L-shaped member 44 and the object 18 is sufficiently great, the object 18 slips from underneath the L-shaped member 44 much like a marble would from the fingers of the marble player. This propels the object 18 up the inclined ramp 46 until it is expelled onto the playing surface 48. The playing surface 48 is integrally formed as a part of upper housing 14. Upper housing 14 generally has a wedge shape when viewed from the side and this results in playing surface 48 being slanted back toward the end wherein the counter 36 is located when the game 10 is located on a level surface. As a result the object 18 will tend to roll under the influence of gravity toward the flippers 32 and 34.

A space 50 is provided between the ends of the right and left flippers 32 and 34 which is of a greater width than the object 18. This allows the object 18 to roll between the flippers 32 and 34 and be deposited into channel 52 located behind right flipper button 24. Channel 52 leads the object 18 back into position to once again be acted on by the object button 22. Thus, the object 18 can be continually circulated up the inclined ramp 46, down the playing surface 48, through the space 50 and into the channel 52.

The counter 36 consists of a rotary drum 54 having a plurality of indicia located thereon, but not illustrated in the drawings, portions of which are step-wise viewable through the counter 36. The counter 36 counts how many times the object 18 passes through the channel 52, it being an object of the game to strike the object target members 28 a sufficient number of times to move them as hereinafter described with the least number of passes of the object 18 through the channel 52. To state this another way, it is an object of the game to only have to propel the object 18 a minimum number of times with the object button 22.

The counter 36 works as follows. Only one of the indicia located on the drum 54 is viewable through the counter 36. The remainder of the indicia is hidden within the upper housing 14. The drum 54 is located on an axle 56 appropriately journaled in bearing surfaces (not identified) on the bottom part of upper housing 14. Located on one end of axle 56 is a pinion 58. This pinion meshes with a crown gear 59 located on the other side of crank disk 60. A bell crank 62 interacts with pin 64 on crank disk 60. Bell crank 62 is biased by spring 66 which in turn, as viewed in FIG. 2, will tend to rotate crank disk 60 in a counterclockwise manner.

The rotation of crank disk 60 and consequently drum 54, however, are governed by an escapement mechanism which includes an escapement wheel 68 located on the end of drum 54 interacting with an escapement lever 70 which is integrally formed and forms a part of an object detection lever 72. The object detection lever 72 is pivotally mounted on the underside of playing surface 48 via a small axle 74 appropriately mounted in bearings (not numbered) integrally formed with and projecting from the underside of playing surface 48. A hole, not shown in the drawing but immediately located behind object detection lever 72, goes through playing surface 48. A projection 76 (the underside being viewable in FIG. 2) integrally formed with object detection lever 72 projects through this hole and is immediately located within channel 52. When an object 18 rolls through the channel 52 it rolls across the projection 76 depressing it, which causes the object escapement lever 72 to rotate about axle 74 allowing the escapement lever 70 to interact with escapement wheel 68 causing drum 54 to rotate through a few degrees about its axle 56 exposing a different indicia through the counter 36. The indicia are chosen such that they represent a numerical value allowing the player of the game to quickly determine how many times he has launched the object 18 via the object button 22.

Figure 8:
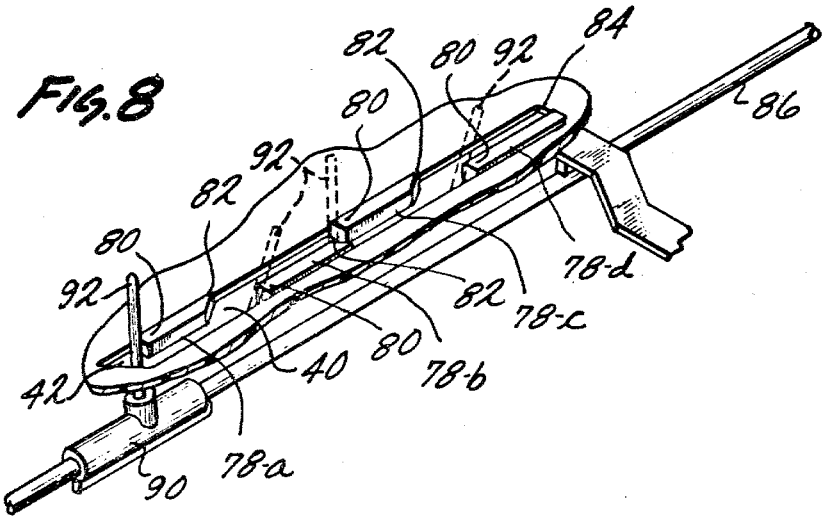
FIG. 8 is a partial oblique view partially cut away of certain components of the invention located in the center of FIG. 2.

The passageways 40 form elongated holes or slots through the playing surface 48. As is best seen in FIGS. 1 and 8, located on alternate sides of the passageways 40 are a series of abutments or projections collectively identified by the numeral 78. The abutments 78 form a serpentine-like pathway through the passageways 40. The ends 80 of the abutments 78 closest to end 42 of passageway 40 is square; that is, it forms a 90 degree angle with the side of passageway 40. The opposite ends 82 of the abutments 78 are oblique to the sides of passageway 40. Thus, any object projecting through and travelling along passageway 40 from the end 42 to the opposite end 84 of passageway 40 will be retained against the square end 80 and captured by the abutment 78. However, if the object is travelling in the direction from end 84 to end 42 it will slide across the oblique surfaces of ends 82 of the abutments 78 past the abutments 78. The end 84 of the passageway 40 will interchangeably be referred to as the signaling position. The end 42 was, as previously noted, interchangeably referred to as the initial position. The abutments inbetween can be considered as intermediate positions.

Lying directly underneath each of the passageways 40 is an elongated guide shaft 86 appropriately mounted to the bottom of playing surface 48 by retaining members collectively identified by the numeral 88 integrally formed with and projecting from the bottom of playing surface 48. Slidably mounted on each of the guide shafts 86 is a sliding member 90 which is free to traverse both along the longitudinal axis of guide shaft 86 as well as to rotate on the guide shaft 86. An upstanding target member 92 is mounted in each of the sliding members 90 and projects upwardly through the passageway 40. As the target members 92 travel from end 42 to end 84 of passageways 40, they are capable of being retained against the ends 80 of the abutments 78, but as they travel in the opposite direction they will slide past the oblique ends 82 of the abutments 78.

Attaching to each of the sliding members 90 is a biasing spring 94 which biases the sliding members 90 and consequently the target members 92 attached thereto toward end 84 of passageways 40. The object target members 28 fit over the target members 92 and consequently they too are biased toward end 84 of passageways 40. When a target member 92, such as the one illustrated in FIG. 8, is retained against one of the abutments 78 as shown in solid lines in FIG. 8, it will, if struck from the left hand side, move transversely to the longitudinal axis of passageway 40 and be freed of end 80 of abutment 78. As this happens sliding member 90 will rotate about guide shaft 86 and under the influence of spring 94 be pulled along the guide shaft 86 until the target member 92 becomes lodged against the end of abutment **78*b*. A blow from the right hand side to target member 92 will then cause target member 92 to move transversely to the left freeing itself from abutment 78*b* and allowing it to slide against abutment 78*c*. This will be repeated as shown in phantom lines in FIG. 8 to abutment 78*d* and finally the target member 92 will become lodged in end 84 of passageway 40**, its signaling position.

The object target members 28 are a one-piece unit having an upper surface, a skirt, and a centralized hollow boss (not separately identified or numbered) which allows them to be set on target members 92 such that the target members 92 are located within the interior of the hollow bosses. The inside diameter of the hollow boss is larger than the outside diameter of the target member 92 which allows the object target members 28 to be retained in a wobbly manner on the target member 92. Additionally this allows the object target member 28 to rotate freely on the target members 92. Positioned around the periphery of the object target members 28 are a series of flanges collectively identified by the numeral 96. If an object 18 going across the playing surface 48 strikes one of the object target members 28 it can cause the object member 28 to spin, wobble or if the blow comes almost transversely to the longitudinal direction of the passageway 40, the impulse of the object 18 against the target member 28 will be transmitted to the target member 92 causing it to be dislodged from whatever abutment 78 it was located against and slide up the passageway 40 toward the next abutment 78 closer to end 84. These tops of object target members 28 are located closer to the plastic cover 16 such that while the object target members 28 are free to move about the target members 92, they cannot be raised a sufficient amount to dislodge them from the target members 92.

The reset button 30 is integrally formed as a part of a cocking member 98. Cocking member 98 slides along the side of upper housing 14 proximal to slot 100. Slot 100 allows reset button 30 to project out of the upper housing 14. Projecting transverse to cocking member 98 is a transverse member 102 which, since it is attached to cocking member 98, also slides with it. Attaching to the underside of playing surface 48 and to cocking member 98 is a spring 104 which biases cocking member 98 toward the top of the game as viewed in FIG. 2. Transverse member 102 fits across the elongated guide shafts 86 and when cocking member 98 is slid against the bias of spring 104 transverse member 102 engages with and slides sliding member 90 along the elongated guide shaft 86 toward end 42 of passageways 40. As noted above, when the slide members are slid in this direction the target member 92 slides against the oblique ends 82 of the abutments 78 and thus is not retained by the abutments 78, but is free to slide all the way to end 42 of passageway 40. As it moves, the cocking member 98 also engages bell crank 62 causing it to rotate against the bias of spring 66 which in turn rotates drum 54. The rotation of drum 54 is such that the indicia are moved back to a start position where they are ready to start indicating the amount of times the object 18 is launched.

In addition to moving the sliding member 98 and the bell crank 62 the cocking member 98 via transverse member 102 engages a flange 106 projecting upwardly from a sliding member 108 located in two track members collectively identified by the numeral 110 formed on the bottom side of playing surface 48. Sliding member 108 has a rack of gear teeth 112 formed on one end thereof and is biased by spring 114 in a direction toward the top of the upper housing 14 as viewed in FIG. 2.

A bell 116 attaching to an upstanding boss (not shown in the figures), which projects from the bottom of playing surface 48, is activated by rotary bell clanger 118. Rotary bell clanger 118 is composed of a metal disk 120 having a central axle 122 integrally formed with the metal disk 120. Located on one surface of the metal disk 120 is a plastic spacer 124 and a plastic retainer 126. Two small axles, both collectively identified by the numeral 128, integrally formed with the metal disk 120, project toward retainer 126. Two small washers, collectively identified by the numeral 130 are freely mounted by axles 128 between disk 120 and retainer 126. Retainer 126 is force fitted over axle 122 holding it firmly in position and retaining washers 130 about their axles 128.

When the metal disk 120 is caused to spin as hereinafter explained the washers 130 are forced outward by the rotation and contact the surface of bell 116 causing the same to emit a ringing sound.

Formed about axle 122 on metal disk 120 is a pinion 132. A gear mounting member 134 is rotatably mounted about an upstanding boss 136 projecting from the bottom surface of playing surface 48. A gear 138 having a set of pinion teeth 140 and a set of spur teeth 142 is rotatably mounted on gear mount member 134. The pinion teeth 140 are always in contact with the rack of gear teeth 112 on sliding member 108. The spur teeth 142, however, because gear mounting member 134 is free to pivot slightly about boss 136 will engage with pinion 132 rotating metal disk 120 when the rack of gear teeth 112 are moving in a direction toward the top of FIG. 2, but will disengage from pinion 132 when the rack of gear teeth 112 are moving in a direction toward the bottom of FIG. 2. Thus, when sliding member 108 as viewed in FIG. 2 is being slid downwardly by transverse member 102, spur teeth 142 will not engage with pinion 132, but when the sliding member 108 is moved upwardly under the bias of spring 114 gear mounting member 134 will rotate clockwise slightly engaging the spur teeth 142 with the pinion 132 causing rotation of rotary bell clanger 118.

Spinning disk 38 is rotatably mounted within upper housing 14 and has a set of spur teeth 144 on its underside. These spur teeth are always in contact with pinion 132. Therefore, whenever the rotary bell clanger 118 is caused to spin, the spinning motion is also transferred to spinning disk 38 spinning the same creating a visual signal in conjunction with the audible signal of the bell 116.

Metal disk 120 also has a set of ratchet teeth 146 formed on the surface wherein pinion 132 is located. Three bell cranks 148, 150 and 152 are appropriately rotatably mounted upon upstanding bosses, not numbered, on the bottom of playing surface 48. Each of the bell cranks 148 through 152 are located such that one of their ends is in operative engagement with the ratchet teeth 146 while the other of their ends is located in the pathway of one of the sliding members 90 such that when each of the sliding members 90 slides from the abutment **78*d* into end 84 of passageway 40, the sliding members 90 individually engage one of the bell cranks 148, 150 and 152 causing them to rotate about their attachment boss such that their opposite end becomes disengaged from the ratchet teeth 146**.

A spring 154 is attached to bell cranks 148 and 150 biasing them such that unless acted upon by the sliding members 90 they will engage with the ratchet teeth 146. Additionally, bell crank 152 is biased by spring 156 to do the same thing. Because of this, the bell cranks 148 through 152 must all be disengaged simultaneously from the ratchet teeth 146 before the rotary bell clanger 114 will be free to spin under the influence of sliding member 108. All of the sliding members 90 must be located in unison in their signaling position at end 84 of passageway 40 before the bell 116 will be rung and the spinning disk 138 will spin. It is therefore an object of the game to use the object 18 to cause each of the target members 92 to be moved to their signaling position such that the bell 116 and the spinning disk 38 will be activated.

The rotary bell clanger 118 is fixedly held in its position adjacent to bell 116 by interaction of its axle 122 with a bearing surface formed in the bottom of playing surface 48 as well as a bearing surface formed in arm 158 appropriately attached to the bottom of playing surface 48.

Identically to other pinball games, the flippers 32 and 34 can be used to propel the object 18 across the playing surface 48 without relaunching the object 18 via button 22. Each of the flippers 32 and 34 are identical in function and as such they will be discussed with most parts being identified by like numerals interchangeably. The flipper 32 has a flipper member 160 which has a hub 162 having a bearing 164 formed in its center. Projecting from the top of playing surface 48 are two identical upstanding bosses collectively identified by the numeral 166. The flipper member 160 rests on the playing surface 48 by locating the bearing 164 and hub 162 over the right side boss 166. Attaching to the hub 162 is a finger section 168 having a surface 170 which engages with and accelerates the object 18 across the playing surface 48 when the flipper member 160 is appropriately activated.

The second part of right flipper member 32 is button member 172. Button member 172 has a top surface 174 with a skirt 176 projecting downwardly from and integrally formed with the top surface 174. Within the interior of the button member 172 and projecting downwardly within this skirt 176 from the top surface 174 is a peg 178. Formed on the inside surface of skirt 176 is a flange serving as a cam follower 180.

Figure 4:
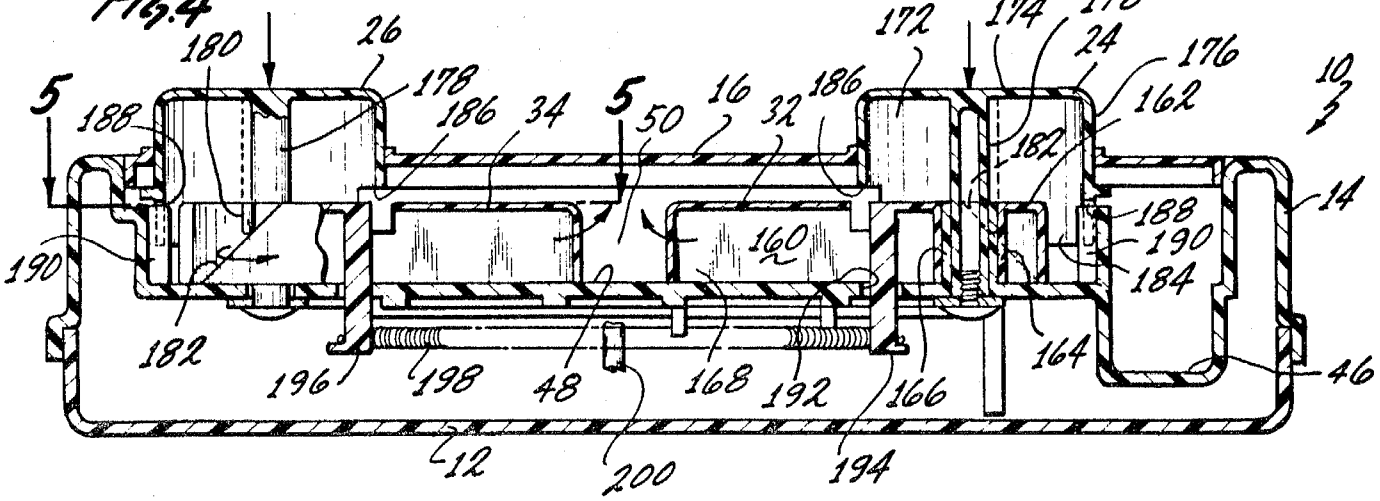
FIG. 4 is an end elevational view in section about the lines 4—4 of FIG. 2 showing operation of the flipper mechanism of the invention.
Figure 6:
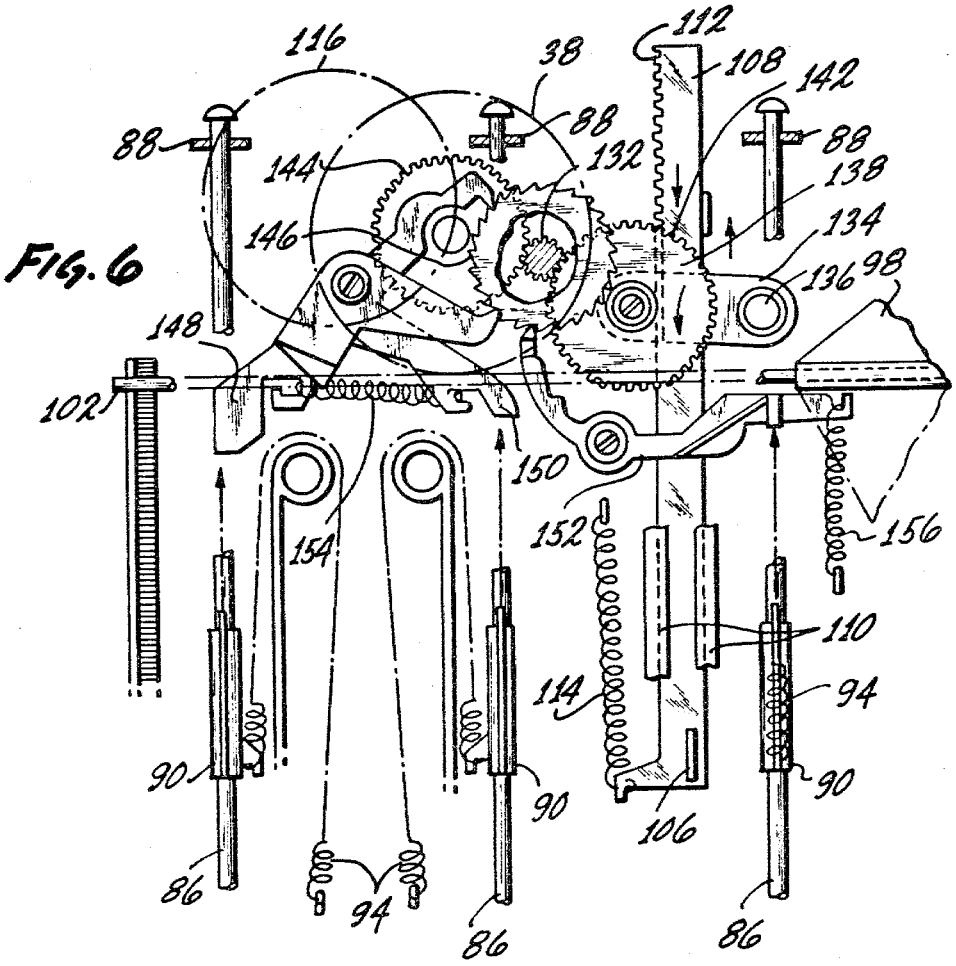
FIG. 6 is a bottom plan view similar to the upper portion of FIG. 2 showing certain of the working components in a working relationship than that shown in FIG. 2.
Figure 7:
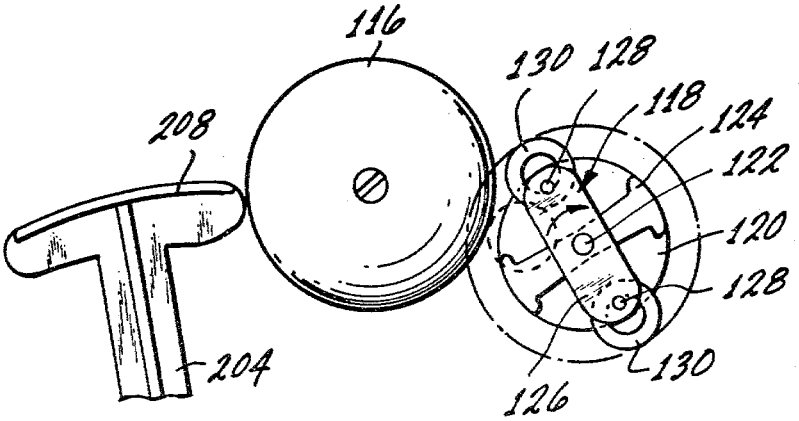
FIG. 7 is a bottom plan view of the bell portion of the invention found in the upper portion of FIG. 2.

The outside of hub 162 is generally cylindrical in shape. Traversing across the cylindrical surface is a spirally inclined cam 182. After flipper member 160 is appropriately mounted about boss 166, button member 172 is located over the flipper member 160 and peg 178 fits within the interior of boss 166. This positions cam follower 180 near the top of the spirally inclined cam surface 182. A skirt extension 184 projects downwardly from a portion of skirt 176. The skirt extension 184 is not continuous around button member 172, but has a cutout 186 allowing the button member 172 to fit over the flipper 160 such that the flipper 160 is located within the cutout 186. A second cutout 188 narrower than the first cutout 186 is also formed in the skirt extension 184. The portion of upper housing 14 which fits around the button member 172 as is best seen in FIG. 4 contains a flange 190 oriented in a vertical manner. The flange 190 fits within the cutout 188 and prevents the button member 172 from rotating.

Normally the button member 172 simply rests on the flipper member 160 with the cam follower 180 frictionally engaged against the upper part of the spirally inclined cam surface 182. When the button member 172 is depressed by a finger of the player using the game, the cam follower 180 pushes against the spirally inclined cam 182. This imparts a rotational tort to both the button member 172 and the flipper member 160. However, because the flange 190 is positioned within the cutout 188 the button member 172 is fixedly held against any rotation. All of the rotation is therefore imparted to the flipper member 160. This causes the flipper member 160 to rotate about the boss 166 and if an object 18 is located against surface 170 the object 18 will be accelerated as the flipper member 160 rotates about or is flipped about boss 166.

Extending downwardly through an appropriate cutout 192 in the playing surface 48 is an extension 194 integrally formed on the bottom of hub 162. Likewise, the other flipper has a similar cutout 192 and an extension 196. A spring 198 is attached to both extensions 194 and 196 and is stretched around a peg 200 formed on the underside of playing surface 48. This biases the extensions 194 and 196 in a counterclockwise and clockwise direction respectively for the right and left side flippers which retract the flippers back toward the counter 36 and raise the button member 172 upwardly in a ready position. When the button member 172 is depressed and a flipping member 160 rotates, the spring 198 is stretched further and when the button member 172 is released, the flipper member 160 rapidly returns to its ready position. This allows for very rapid activation of the right and left flippers 32 and 34.

Each time one of the flippers 32 or 34 are activated the bell 116 is also caused to be rung. A sliding member 202 slidably mounted on the bottom of playing surface 48 fits against both extensions 94 and 96. A clanging lever 204 having a fulcrum point about upstanding boss 206 located on the bottom of playing surface 48 has a hammer-like end 208 positioned proximal to bell 116. The other end of clanging lever 204 has a slot 210 which fits around a peg 212 located on sliding lever 202. Whenever extensions 194 or 196 are caused to move, this movement is transferred to sliding lever 202 which in turn transfers it to clanging lever 204 causing the hammer end 208 to strike the bell 166 a single time. Integrally formed with sliding lever 202 is a spring lever 214 which fits against a projection 216 on the bottom of playing surface 48 which biases sliding lever 202 toward extensions 194 and 196.

A small tab 218 projects rearwardly from left flipper 34. An indent 220 in upper housing 14 is sized to allow object 18 to be located therein. For storage purposes the object 18 is located within indent 220 by depressing the button member 172 of left flipper 34 until tab 218 clears the top of indent 220 allowing object 18 to be located within the indent 220. The button is then released allowing tab 218 to close over indent 220 locking the object 18 within the indent 220 so that it does not haphazardly rattle around the top of the playing surface 48.

I claim:

1. A flipper mechanism for use with a pinball game having a playing surface and at least one object which is propelled by said flipper mechanism across said playing surface which comprises:

said playing surface including at least one upstanding boss projecting upwardly from said surface, said boss including a hollow interior;

a flipper member having a hub section and a finger section, said finger section including a striking surface for contacting and accelerating said object across said playing surface, said hub portion including a bearing means fitting over and rotating about said upstanding boss on said playing surface, at least a portion of said hub portion having a generally cylindrical-like surface which includes a spirally inclined cam means integrally formed on said cylindrical-like surface;

a button member, said button member including a top surface, a cylindrical skirt extending from said top surface, and a peg extending from the underside of said top surface downwardly from said top surface and essentially centralized within the interior of said skirt;

a cam follower means located on the interior of said skirt and projecting toward said peg;

said hub portion of said flipper member fitting over said upstanding boss locating said flipper member on said playing surface, said peg slidably fitting into said hollow interior of said boss locating said button member over said flipper member and positioning said cam follower means in operative association with said spirally inclined cam means such that when said button member is depressed toward said playing surface said cam follower means slides against said spirally inclined cam means rotating said flipper member about said upstanding boss.

2. The flipper mechanism of claim 1 including:

said button member having a skirt extension projecting downwardly and integrally formed with said skirt, said skirt extension including a cutout section such that when said button member is located over said flipper member said flipper member fits within said cutout section of said skirt extension.

3. The flipper mechanism of claim 2 wherein:

said skirt extension includes a second cutout section and said playing surface includes an upstanding flange, said flange fitting into said second cutout section preventing rotation of said button member.

4. The flipper mechanism of claim 3 wherein:

said spirally inclined cam means includes a spirally inclined cam surface formed on said cylindrical-like surface and said cam follower means comprises a flange member located on the interior of said skirt.

* * * * *